US007861479B2

(12) United States Patent
Crosby et al.

(10) Patent No.: US 7,861,479 B2
(45) Date of Patent: Jan. 4, 2011

(54) INSULATED FOAM PANEL FORMS

(75) Inventors: Bradley J. Crosby, Omaha, NE (US); Michael D. Hays, Omaha, NE (US); Jeffrey A. Blake, Omaha, NE (US); Patrick D. Gredys, Omaha, NE (US)

(73) Assignee: Airlite Plastics, Co., Omaha, NE (US)

( * ) Notice: Subject to any disclaimer, the term of this patent is extended or adjusted under 35 U.S.C. 154(b) by 811 days.

(21) Appl. No.: 10/598,657

(22) PCT Filed: Jan. 11, 2006

(86) PCT No.: PCT/US2006/000783

§ 371 (c)(1),
(2), (4) Date: Sep. 7, 2006

(87) PCT Pub. No.: WO2006/098800

PCT Pub. Date: Sep. 21, 2006

(65) Prior Publication Data

US 2008/0229692 A1 Sep. 25, 2008

Related U.S. Application Data

(60) Provisional application No. 60/644,421, filed on Jan. 14, 2005.

(51) Int. Cl.
*E04B 2/00* (2006.01)

(52) U.S. Cl. ..... 52/426; 52/427; 52/428; 52/309.11; 52/309.12

(58) Field of Classification Search ..... 52/426, 52/427, 428, 309.11, 309.12, 585.1; 249/194, 249/47

See application file for complete search history.

(56) References Cited

U.S. PATENT DOCUMENTS

| | | | |
|---|---|---|---|
| 963,776 | A | 7/1910 | Kosack |
| 1,694,665 | A | 12/1928 | Parker |
| 1,719,749 | A | 7/1929 | Berman |
| 1,746,816 | A | 2/1930 | Boes |
| 1,796,973 | A | 3/1931 | Wright |
| 1,836,408 | A | 12/1931 | Sutton |
| 1,895,801 | A | 1/1933 | Keller |
| 2,029,082 | A | 1/1936 | Odam |
| 2,127,914 | A | 8/1938 | Hadland |
| 2,177,246 | A | 10/1939 | Ellis |
| 2,201,110 | A | 5/1940 | Makram |
| 2,392,551 | A | 1/1946 | Roe |
| 2,749,739 | A | 6/1956 | Zagray |
| 3,383,817 | A | 5/1968 | Gregori |
| 3,391,507 | A | 7/1968 | Downing |
| 3,534,518 | A | 10/1970 | Zagray |

(Continued)

FOREIGN PATENT DOCUMENTS

| | | |
|---|---|---|
| CA | 2142517 | 8/1995 |

(Continued)

*Primary Examiner*—Richard E Chilcot, Jr.
*Assistant Examiner*—Jessica Laux
(74) *Attorney, Agent, or Firm*—Banner & Witcoff, Ltd

(57) ABSTRACT

A corner bracket for modular foam forms for poured concrete walls includes an outer, horizontal strap with generally vertical strips attached thereto or molded therewith for encapsulation in the outside and optionally the inside foam panels of such a form.

34 Claims, 8 Drawing Sheets

U.S. PATENT DOCUMENTS

| | | | | |
|---|---|---|---|---|
| 3,552,076 | A | | 1/1971 | Gregoria |
| 3,740,909 | A | | 6/1973 | Stinnes |
| 3,780,484 | A | | 12/1973 | Muse |
| 3,788,020 | A | | 1/1974 | Gregori |
| 3,895,469 | A | | 7/1975 | Kapitan |
| 3,924,376 | A | | 12/1975 | Tsurumi |
| 3,959,944 | A | | 6/1976 | Oroschakoff |
| 3,992,844 | A | | 11/1976 | Gretter |
| 4,021,989 | A | | 5/1977 | Hala |
| 4,022,644 | A | | 5/1977 | Smith, Jr. |
| 4,034,529 | A | | 7/1977 | Lampus |
| 4,075,808 | A | | 2/1978 | Pearlman |
| 4,090,337 | A | | 5/1978 | Szekeres |
| 4,107,895 | A | | 8/1978 | LeGrady |
| 4,133,156 | A | | 1/1979 | Unger |
| 4,185,423 | A | | 1/1980 | Gutierrez |
| 4,223,501 | A | | 9/1980 | DeLozier |
| 4,226,061 | A | | 10/1980 | Day, Jr. |
| 4,229,920 | A | | 10/1980 | Lount |
| 4,240,233 | A | | 12/1980 | Vercelletto |
| 4,263,765 | A | | 4/1981 | Maloney |
| 4,321,779 | A | | 3/1982 | Kratchmer |
| 4,348,847 | A | | 9/1982 | Jukes |
| 4,366,657 | A | | 1/1983 | Hopman |
| 4,402,167 | A | | 9/1983 | Denucci |
| 4,406,103 | A | | 9/1983 | Ghali et al. |
| 4,407,102 | A | | 10/1983 | Boyack |
| 4,433,520 | A | | 2/1984 | Maschhoff |
| 4,433,521 | A | | 2/1984 | Dietrich |
| 4,433,522 | A | | 2/1984 | Yerushalmi |
| 4,438,612 | A | | 3/1984 | Bernard et al. |
| 4,439,967 | A | | 4/1984 | Dielenberg |
| 4,442,644 | A | | 4/1984 | Jukes |
| 4,471,590 | A | | 9/1984 | Roberts et al. |
| 4,473,985 | A | | 10/1984 | Hunt |
| 4,479,338 | A | | 10/1984 | Robertson |
| 4,516,372 | A | | 5/1985 | Grutsch |
| 4,551,870 | A | | 11/1985 | Presti, Jr. |
| 4,565,043 | A | | 1/1986 | Mazzarese |
| 4,571,909 | A | | 2/1986 | Berghuis et al. |
| 4,577,447 | A | | 3/1986 | Doran |
| 4,598,519 | A | | 7/1986 | Reid |
| 4,599,830 | A | | 7/1986 | Nawrot |
| 4,604,843 | A | | 8/1986 | Ott et al. |
| 4,632,796 | A | | 12/1986 | Moulet |
| 4,648,228 | A | | 3/1987 | Kiselewski |
| 4,655,014 | A | | 4/1987 | Krecke |
| 4,694,624 | A | | 9/1987 | Juhas |
| 4,698,947 | A | | 10/1987 | McKay |
| 4,700,523 | A | | 10/1987 | Kohara |
| 4,706,429 | A | | 11/1987 | Young |
| 4,730,422 | A | | 3/1988 | Young |
| 4,731,968 | A | | 3/1988 | Obino |
| 4,742,659 | A | | 5/1988 | Meilleur |
| 4,750,307 | A | | 6/1988 | Slager |
| 4,750,308 | A | | 6/1988 | McKay |
| 4,765,109 | A | | 8/1988 | Boeshart |
| 4,773,199 | A | | 9/1988 | Kohara |
| 4,788,020 | A | | 11/1988 | Yampolsky et al. |
| 4,791,767 | A | | 12/1988 | Boeshart |
| 4,811,927 | A | | 3/1989 | Slonimsky et al. |
| 4,817,353 | A | | 4/1989 | Woods et al. |
| 4,825,618 | A | | 5/1989 | Blevins |
| 4,835,928 | A | | 6/1989 | Scott |
| 4,852,317 | A | | 8/1989 | Schiavello et al. |
| 4,852,319 | A | | 8/1989 | Cowan |
| 4,860,515 | A | | 8/1989 | Browning, Jr. |
| 4,862,660 | A | | 9/1989 | Raymond |
| 4,864,792 | A | | 9/1989 | Andre et al. |
| 4,866,891 | A | | 9/1989 | Young |
| 4,879,855 | A | | 11/1989 | Berrenberg |
| 4,883,396 | A | | 11/1989 | Shamah et al. |
| 4,884,382 | A | | 12/1989 | Horobin |
| 4,885,888 | A | | 12/1989 | Young |
| 4,888,931 | A | | 12/1989 | Meilleur |
| 4,889,310 | A | | 12/1989 | Boeshart |
| 4,894,969 | A | | 1/1990 | Horobin |
| 4,901,494 | A | | 2/1990 | Miller et al. |
| 4,916,879 | A | * | 4/1990 | Boeshart ..... 52/426 |
| 4,936,540 | A | | 6/1990 | Boeshart |
| 4,938,449 | A | | 7/1990 | Boeshart |
| 4,949,515 | A | | 8/1990 | Krecke |
| 4,967,528 | A | | 11/1990 | Doran |
| 4,972,646 | A | | 11/1990 | Miller et al. |
| 4,974,388 | A | | 12/1990 | Fischer |
| 4,976,081 | A | | 12/1990 | Litzenberger |
| 4,998,394 | A | | 3/1991 | Holzapfel et al. |
| 5,014,480 | A | | 5/1991 | Guarriello et al. |
| 5,024,035 | A | | 6/1991 | Hanson et al. |
| 5,060,446 | A | | 10/1991 | Beliveau |
| 5,065,561 | A | | 11/1991 | Mason |
| 5,086,600 | A | | 2/1992 | Holland et al. |
| 5,092,093 | A | | 3/1992 | Lu |
| 5,097,644 | A | | 3/1992 | Hun |
| 5,099,628 | A | | 3/1992 | Noland et al. |
| 5,099,630 | A | | 3/1992 | Bolmgren |
| 5,107,648 | A | | 4/1992 | Roby |
| 5,117,600 | A | | 6/1992 | Yerushalmi |
| 5,122,015 | A | | 6/1992 | Shen |
| 5,123,222 | A | | 6/1992 | Guarriello et al. |
| 5,140,794 | A | | 8/1992 | Miller |
| 5,163,261 | A | | 11/1992 | O'Neill |
| 5,174,083 | A | | 12/1992 | Mussell |
| 5,274,968 | A | | 1/1994 | Pardo |
| 5,323,578 | A | | 6/1994 | Chagnon et al. |
| 5,337,530 | A | | 8/1994 | Beames |
| 5,350,256 | A | | 9/1994 | Hammer |
| 5,351,455 | A | | 10/1994 | Schoonover et al. |
| 5,351,456 | A | | 10/1994 | Paine, Jr. |
| 5,390,459 | A | | 2/1995 | Mensen |
| 5,428,933 | A | | 7/1995 | Philippe |
| 5,454,199 | A | | 10/1995 | Blom et al. |
| 5,459,970 | A | | 10/1995 | Kim |
| 5,459,971 | A | | 10/1995 | Sparkman |
| 5,465,542 | A | | 11/1995 | Terry |
| 5,473,850 | A | | 12/1995 | Balding |
| 5,491,949 | A | | 2/1996 | De Moor |
| 5,535,565 | A | | 7/1996 | Majnaric et al. |
| 5,537,797 | A | | 7/1996 | Harkenrider et al. |
| 5,553,430 | A | | 9/1996 | Majnaric et al. |
| 5,566,518 | A | | 10/1996 | Martin et al. |
| 5,566,519 | A | | 10/1996 | Almaraz-Miera |
| 5,566,521 | A | | 10/1996 | Andrews et al. |
| 5,568,710 | A | | 10/1996 | Smith et al. |
| 5,570,552 | A | | 11/1996 | Nehring |
| 5,596,855 | A | | 1/1997 | Batch |
| 5,598,675 | A | | 2/1997 | Pruss |
| 5,608,999 | A | | 3/1997 | McNamara |
| 5,611,182 | A | | 3/1997 | Spude |
| 5,611,183 | A | | 3/1997 | Kim |
| 5,617,693 | A | | 4/1997 | Hefner |
| 5,625,989 | A | | 5/1997 | Brubaker et al. |
| 5,632,126 | A | | 5/1997 | Agsten |
| 5,638,652 | A | | 6/1997 | Shinoda et al. |
| 5,649,401 | A | | 7/1997 | Harrington, Jr. |
| 5,653,082 | A | | 8/1997 | Shinoda et al. |
| 5,657,600 | A | | 8/1997 | Mensen |
| 5,657,601 | A | | 8/1997 | Bean et al. |
| 5,658,483 | A | | 8/1997 | Boeshart |
| 5,688,078 | A | | 11/1997 | Hammer |
| 5,692,356 | A | | 12/1997 | Baxter |

| | | | |
|---|---|---|---|
| 5,695,676 | A | 12/1997 | Lee |
| 5,699,640 | A | 12/1997 | Bourgeois et al. |
| 5,701,710 | A | 12/1997 | Tremelling |
| 5,704,180 | A | 1/1998 | Boeck |
| 5,709,060 | A | 1/1998 | Vaughan et al. |
| 5,709,061 | A | 1/1998 | Dietrich |
| 5,715,635 | A | 2/1998 | Sherwood |
| 5,735,093 | A | 4/1998 | Grutsch |
| 5,740,648 | A | 4/1998 | Piccone |
| 5,768,851 | A | 6/1998 | Nagaoka |
| 5,782,050 | A | 7/1998 | Boeshart |
| 5,802,793 | A | 9/1998 | DeVore, Jr. |
| 5,802,795 | A | 9/1998 | Myers et al. |
| 5,803,669 | A | 9/1998 | Bullard |
| 5,809,723 | A | 9/1998 | Keith et al. |
| 5,809,725 | A | 9/1998 | Cretti |
| 5,809,726 | A | 9/1998 | Spude |
| 5,809,727 | A | 9/1998 | Mensen |
| 5,809,728 | A | 9/1998 | Tremelling |
| 5,818,997 | A | 10/1998 | Fasanella et al. |
| 5,819,489 | A | 10/1998 | McKinney |
| 5,836,126 | A | 11/1998 | Harkenrider et al. |
| 5,839,243 | A | 11/1998 | Martin |
| 5,845,445 | A | 12/1998 | Blackbeard |
| 5,845,449 | A | 12/1998 | Vaughan et al. |
| 5,845,455 | A | 12/1998 | Johnson, III |
| 5,852,907 | A | 12/1998 | Tobin et al. |
| 5,857,300 | A | 1/1999 | Gates |
| 5,860,262 | A | 1/1999 | Johnson |
| 5,881,524 | A | 3/1999 | Ellison, Jr. |
| 5,887,401 | A | 3/1999 | Moore, Jr. |
| 5,890,337 | A | 4/1999 | Boeshart |
| 5,895,188 | A | 4/1999 | Cheng |
| 5,896,714 | A | 4/1999 | Cymbala et al. |
| 5,918,427 | A | 7/1999 | VanderWerf |
| 5,930,958 | A | 8/1999 | Stanley |
| 5,930,970 | A | 8/1999 | De Le fevre |
| 5,937,604 | A | 8/1999 | Bowron |
| 5,945,448 | A | 8/1999 | Ninomiya et al. |
| 5,987,830 | A | 11/1999 | Worley |
| 5,992,114 | A | 11/1999 | Zelinsky et al. |
| 6,000,184 | A | 12/1999 | Fernandes |
| 6,070,380 | A | 6/2000 | Meilleur |
| 6,085,476 | A | 7/2000 | Jantzi et al. |
| D429,346 | S | 8/2000 | Martin, Jr. |
| 6,112,491 | A | 9/2000 | Keith et al. |
| 6,122,880 | A | 9/2000 | Kolb et al. |
| 6,131,360 | A | 10/2000 | Dalen |
| 6,148,576 | A | 11/2000 | Janopaul, Jr. |
| 6,151,856 | A | 11/2000 | Shimonohara |
| 6,167,671 | B1 | 1/2001 | Wilson |
| 6,170,220 | B1 | 1/2001 | Moore, Jr. |
| 6,173,937 | B1 | 1/2001 | Cottongim |
| 6,176,059 | B1 | 1/2001 | Cantarano et al. |
| 6,219,984 | B1 | 4/2001 | Piccone |
| 6,224,031 | B1 | 5/2001 | Boeshart |
| 6,226,951 | B1 | 5/2001 | Azar |
| 6,230,462 | B1 | 5/2001 | Beliveau |
| 6,231,024 | B1 | 5/2001 | Kugimiya et al. |
| 6,231,025 | B1 | 5/2001 | Takemura |
| 6,240,692 | B1 | 6/2001 | Yost et al. |
| 6,250,024 | B1 | 6/2001 | Sculthorpe et al. |
| 6,250,033 | B1 | 6/2001 | Zelinsky |
| 6,253,518 | B1 | 7/2001 | Azar |
| 6,253,519 | B1 | 7/2001 | Daniel |
| 6,253,523 | B1 | 7/2001 | McKinnon |
| 6,263,631 | B1 | 7/2001 | Nisbett et al. |
| 6,276,104 | B1 | 8/2001 | Long, Sr. et al. |
| 6,279,285 | B1 | 8/2001 | Kubica |
| 6,293,059 | B1 | 9/2001 | Goodwin |
| 6,293,067 | B1 | 9/2001 | Meendering |
| 6,293,068 | B1 | 9/2001 | Harrington, Jr. |
| 6,301,851 | B1 | 10/2001 | Matsubara |
| 6,308,484 | B1 | 10/2001 | Severino |
| 6,314,694 | B1 | 11/2001 | Cooper et al. |
| 6,314,697 | B1 | 11/2001 | Moore, Jr. |
| 6,318,040 | B1 | 11/2001 | Moore, Jr. |
| 6,321,496 | B1 | 11/2001 | Martin, Jr. |
| 6,321,497 | B1 | 11/2001 | Cormier |
| 6,321,498 | B1 | 11/2001 | Trovato |
| 6,324,804 | B1 | 12/2001 | Hoogstraten |
| 6,332,300 | B1 | 12/2001 | Wakai |
| 6,336,301 | B1 | 1/2002 | Moore, Jr. |
| 6,349,520 | B2 | 2/2002 | Kubica |
| 6,352,237 | B1 | 3/2002 | Severino |
| 6,360,505 | B1 | 3/2002 | Johns |
| 6,363,683 | B1 | 4/2002 | Moore, Jr. |
| 6,378,260 | B1 | 4/2002 | Williamson et al. |
| 6,378,261 | B1 | 4/2002 | Agsten |
| 6,389,758 | B1 | 5/2002 | Martin, Jr. |
| 6,401,413 | B1 | 6/2002 | Niemann |
| 6,401,419 | B1 | 6/2002 | Beliveau |
| 6,405,505 | B1 | 6/2002 | Alberti |
| 6,412,231 | B1 | 7/2002 | Palatin |
| 6,438,917 | B2 | 8/2002 | Kubica |
| 6,438,918 | B2 | 8/2002 | Moore, Jr. et al. |
| 6,474,033 | B1 | 11/2002 | Luchini et al. |
| 6,481,178 | B2 | 11/2002 | Moore, Jr. |
| RE37,981 | E | 2/2003 | Layne |
| 6,519,906 | B2 | 2/2003 | Yost et al. |
| 6,526,713 | B2 | 3/2003 | Moore, Jr. |
| 6,536,172 | B1 | 3/2003 | Amend |
| 6,568,141 | B2 | 5/2003 | Kremers |
| 6,574,934 | B1 | 6/2003 | Queirel |
| 6,578,333 | B1 | 6/2003 | Gagliano |
| 6,609,340 | B2 | 8/2003 | Moore, Jr. et al. |
| 6,647,686 | B2 | 11/2003 | Dunn et al. |
| 6,665,992 | B2 | 12/2003 | Hew |
| 6,668,502 | B2 | 12/2003 | Beliveau |
| 6,668,503 | B2 | 12/2003 | Beliveau |
| 6,681,539 | B2 | 1/2004 | Yost et al. |
| 6,688,066 | B1 | 2/2004 | Cottier et al. |
| 6,691,481 | B2 | 2/2004 | Schmidt |
| 6,761,007 | B2 | 7/2004 | Lancelot, III et al. |
| 6,792,729 | B2 | 9/2004 | Beliveau |
| 6,820,384 | B1 | 11/2004 | Pfeiffer |
| 7,059,577 | B1 | 6/2006 | Burgett |
| 7,082,731 | B2 | 8/2006 | Patz et al. |
| 2004/0216415 | A1 | 11/2004 | Pfeiffer et al. |
| 2005/0204679 | A1 | 9/2005 | Pfeiffer |
| 2005/0223669 | A1 | 10/2005 | Cymbala et al. |
| 2006/0117693 | A1 | 6/2006 | Garrett |
| 2006/0213140 | A1 | 9/2006 | Morin et al. |

FOREIGN PATENT DOCUMENTS

| | | |
|---|---|---|
| CA | 2256091 | 6/2000 |
| CA | 2492969 | 8/2005 |
| CA | 2500682 | 9/2005 |
| EP | 251943 | 1/1988 |
| EP | 275938 | 7/1988 |
| EP | 570717 | 11/1993 |
| FR | 2394647 | 1/1979 |
| GB | 517915 | 2/1940 |
| GB | 1385045 | 2/1975 |
| GB | 2170258 | 7/1986 |
| GB | 2240121 | 7/1991 |
| WO | 0233184 | 4/2002 |

* cited by examiner

FIG. 1
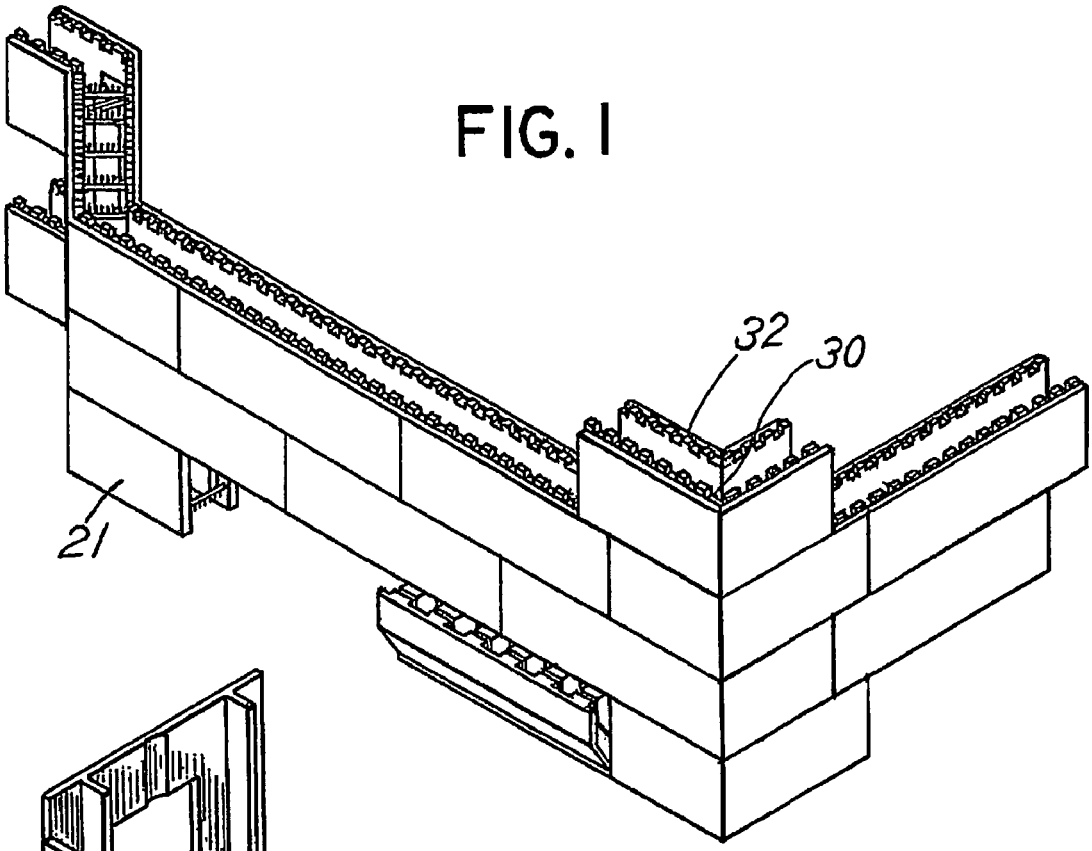
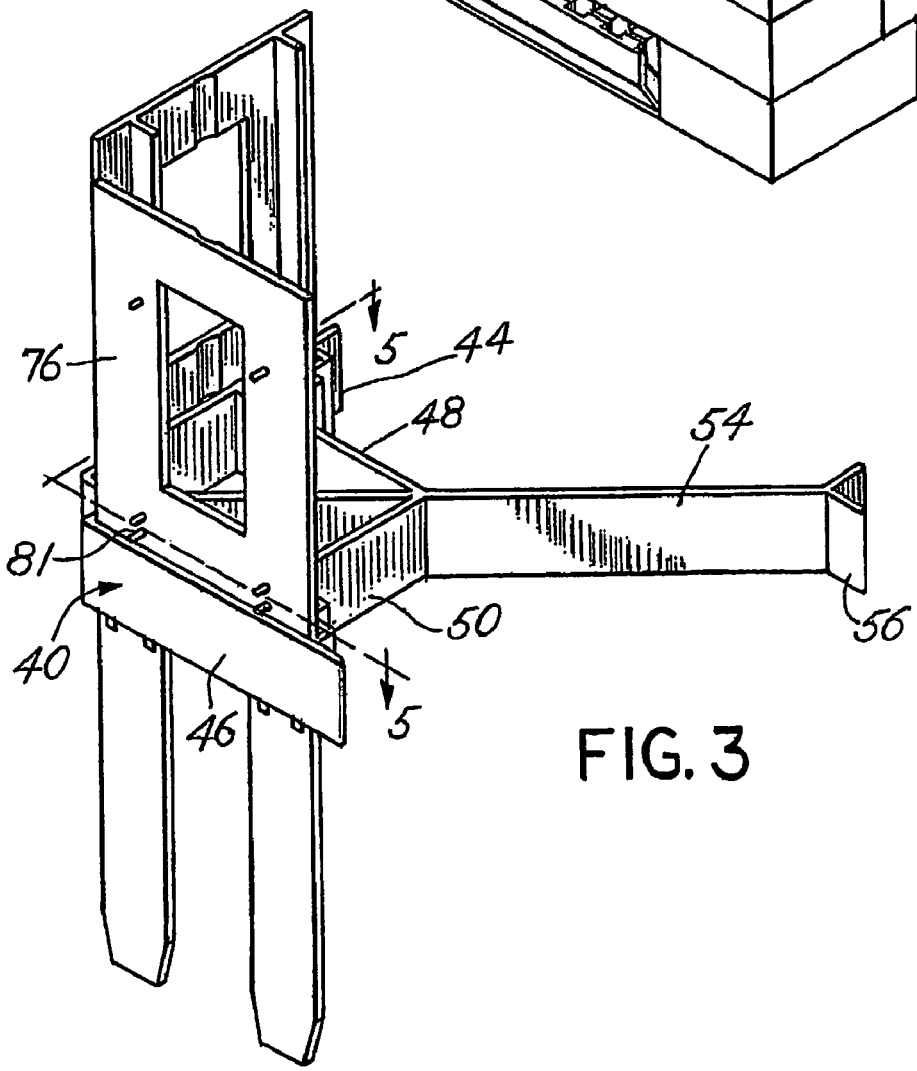
FIG. 3

FIG.7
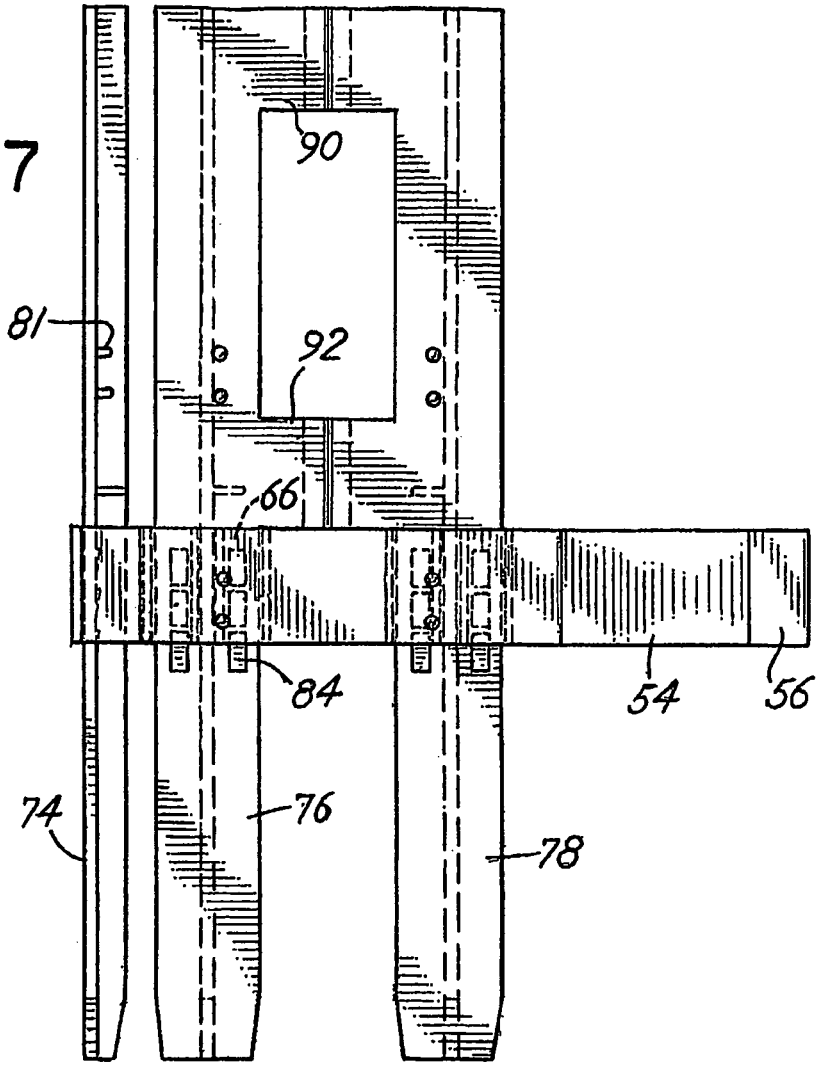
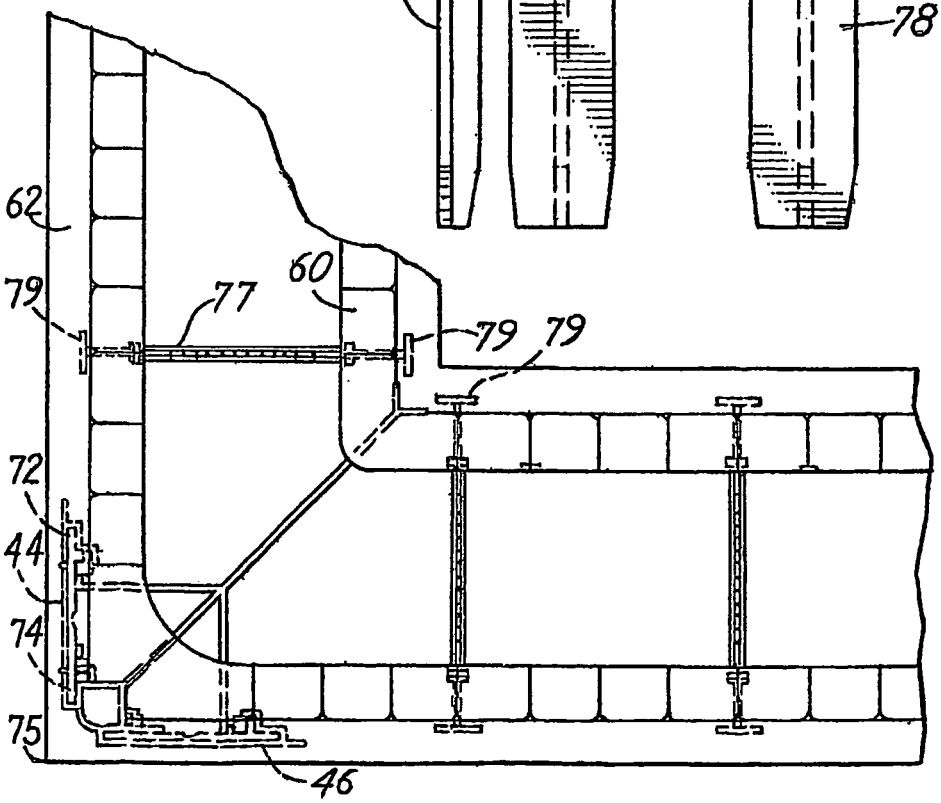
FIG.8

FIG.9
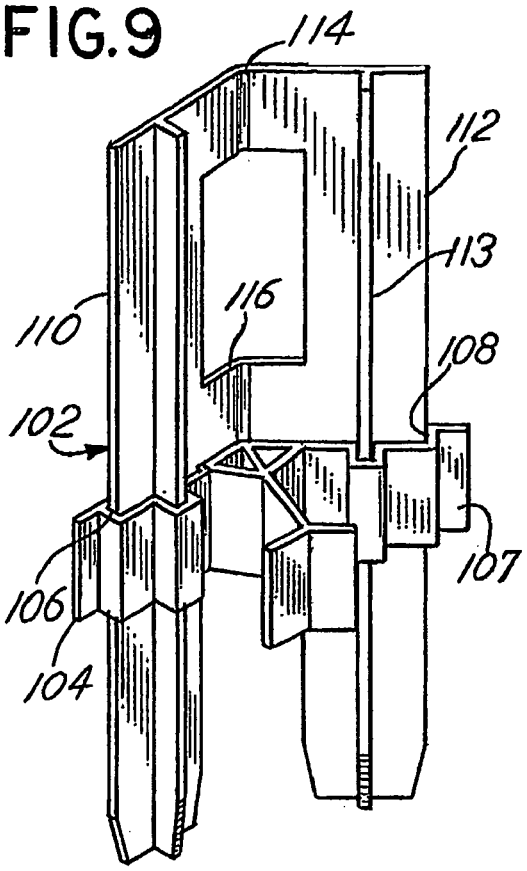
FIG.11
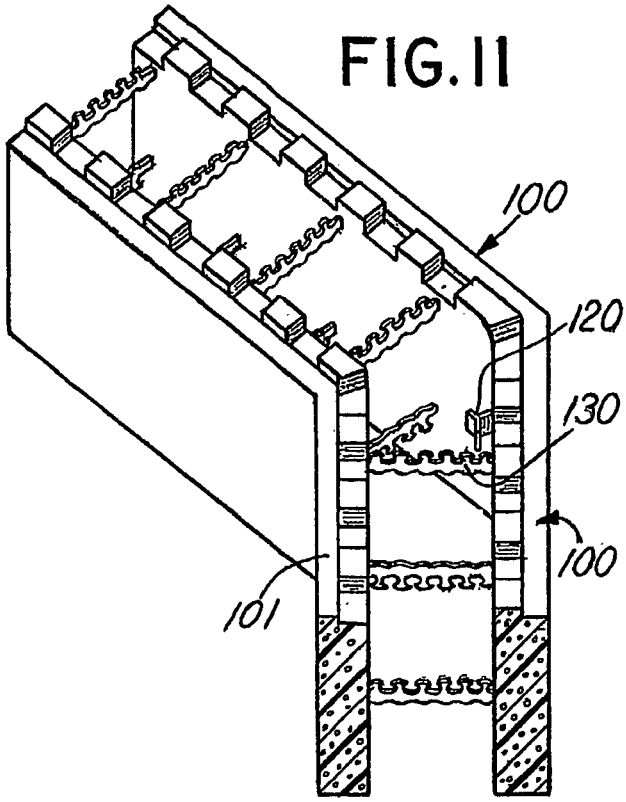
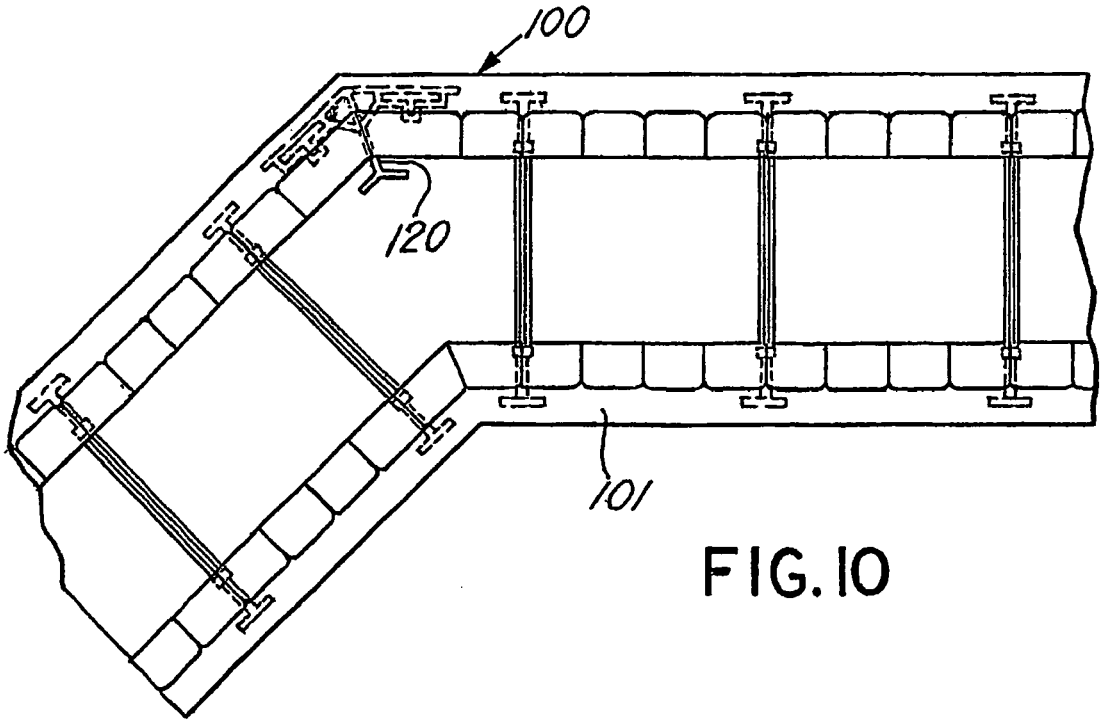
FIG.10

INSULATED FOAM PANEL FORMS

CROSS REFERENCE TO RELATED APPLICATION

This international application is derived from, claims priority to and incorporates by reference U.S. provisional application Ser. No. 60/644,241, filed Jan. 14, 2005, entitled INSULATED FOAM PANEL FORMS

BACKGROUND OF THE INVENTION

In a principal aspect the present invention relates to a device termed a strut, connector, tie, bracket member or bracket, and which is used in combination with spaced, insulating foam, form panels, to thereby provide a mold or form for concrete and cement wall construction. In particular, the bracket is associated with formation of insulating foam, corner forms.

The use of modular insulating foam forms for concrete or cement wall construction is disclosed in various prior art patents and use of such forms is commonly practiced in the construction industry. Among the prior art patents depicting such forms and their use are the following:

| U.S. Pat. No. | Patentee | Date of Patent | Title |
|---|---|---|---|
| 4,884,382 | Horobin | Dec. 5, 1989 | Modular Building-Block Form |
| 5,060,446 | Beliveau | Oct. 29, 1991 | Insulating Wall Panel |
| 5,390,459 | Mensen | Feb. 21, 1995 | Concrete Form Walls |
| 5,896,714 | Cymbala et al. | Apr. 27, 1999 | Insulating Concrete Form System |
| 6,230,462 | Beliveau | May 15, 2001 | Concrete Wall Form and Connectors Therefor |
| 6,820,384 B1 | Pfeiffer | Nov. 23, 2004 | Prefabricated Foam Block Concrete Forms and Ties Molded Therein |

Modular foam forms generally comprise first and second, parallel, spaced, modular sized, plastic foam or polystyrene foam wall panels. The spaced foam wall panels are connected by cross members termed brackets. Brackets are typically made from molded, rigid plastic materials. The brackets are often referred to as struts, ties or connectors. The foamed wall panel forms are made in modular sizes and assembled in building block fashion to define a form for a building or foundation wall. Reinforcing bars (rebars) are typically placed on the ties or brackets that connect or join the foam panels defining the concrete form so that when concrete or cement is poured into the space between the foam panels, the rebars will effectively reinforce the wall. Various designs of the panels and the connectors or brackets which join or tie the panels together are depicted in the prior art. The design of panels and the design of the brackets or connectors or ties is highly varied.

A particularly challenging design problem associated with foam panel forms is related to the corners of such forms. Appropriately positioning of foam material in combination with ties or brackets in a manner which enables and facilitates the construction of the corners of a building wall is particularly vexing. Prior art patents suggest various corner wall form constructions including the following:

| U.S. Pat. No. | Patentee | Date of Patent | Title |
|---|---|---|---|
| 4,765,109 | Boeshart | Aug. 23, 1988 | Adjustable Tie |
| 4,916,879 | Boeshart | Apr. 17, 1990 | Corner Tie |
| 5,658,483 | Boeshart | Aug. 19, 1997 | Corner Joint Tie |
| 5,782,050 | Boeshart | Jul. 21, 1998 | Two-Piece Corner Tie |
| 6,224,031 | Kohrs | May 1, 2001 | Intervertebral Implant with Reduced Contact Area and Method |
| 6,293,067 | Meendering | Sep. 25, 2001 | Tie for Forms for Poured Concrete |
| 6,352,237 | Cizek | Mar. 5, 2002 | Combination Bottle Hook and Wrench |
| 6,691,481 | Schmidt | Feb. 17, 2004 | Corner Form for Modular Insulating Concrete Form System |

The present invention is directed to improved designs of molded plastic brackets, ties or connectors which are especially useful in combination with spaced foam panels to define corner forms.

SUMMARY OF THE INVENTION

Briefly, the present invention comprises a corner bracket or tie which includes a first generally horizontal assembly member having an intermediate or generally, but angled central, corner section with a projecting wing extension extending laterally in generally opposite directions from each side of the intermediate or central, corner section. An integral bracing element typically connects the wing extensions to fix and maintain a desired corner angle between the projecting wing extensions. The wing extensions thus may define and include an angle, for example, of 90°, 60°, 45° or some other included angle that defines or conforms to the angle of the corner wall form incorporating the bracket. In addition to the horizontal assembly member, there is included at least one vertical plate member which is attached to or is attachable to the horizontal assembly member and which is designed to be embedded or included within at least one of the foam panels forming a corner wall form. The vertical plate member or members are thus embedded in the corner foam panel in a manner which positions them for cooperation with fasteners that are used to attach various materials such as siding, wallboard, etc, to the corner foam panels. Such attachment is particularly desirable at corners of such foam forms, and the present invention is especially useful because it provides a design which positions generally vertical plate members adjacent or at the corners of an insulated foam wall form. The vertical plate members are analogous to furring strips.

The corner brackets or ties of the invention are generally at least partially encapsulated into opposed, spaced foam panels which intersect or are molded to define a corner, modular, foam panel form. One embodiment of the bracket is designed for combination with an outside foam corner panel and a spaced inside foam corner panel, and is constructed to be at least partially embedded in both the inside and outside foam panels. Another embodiment of the corner bracket is designed to be at least partially embedded in an outside corner foam panel and to project into the space between an outside corner foam panel and a spaced, inside corner foam panel.

The ties or brackets of the invention thus function to position generally vertical plate members at or adjacent the outside corner insulated foam panel and further optional function to connect an outside corner insulating foam panel to an inside corner foam panel. Also in a preferred embodiment, the corner bracket is comprised of separate elements including (1) a horizontal assembly which defines, or is compatible with, the desired angular relationship of the insulating corner foam panels, and (2) separate, generally vertical plate members which may be slidably inserted into the horizontal corner assembly.

As another feature of the invention, the vertical plate members may be molded as a single vertical element, or multiple, spaced vertical elements joined by cross members. The cross member or members may be rigid or may include an adjustable (living hinge) feature. Two or more vertical elements may be provided for combination with a single horizontal corner assembly. The vertical elements may be slidably positioned through vertical slots in the horizontal corner assembly and retained by a bayonet connection or stops in the form of lugs.

Thus, it is an object of the invention to provide a multiple variety of corner bracket constructions that may be used in combination with a pair of spaced, insulated foam panels to construct an insulated concrete wall corner form.

Another object is to provide a bracket for a corner form which includes one or more vertical plate members or strips adjacent the insulated, outside foam panel.

A further object is to provide a corner bracket and foam panel wall construction form which is rugged, reasonably priced, and easy to incorporate with insulated wall panel forms.

These and other objects, advantages and features are set forth in the following description and claims.

BRIEF DESCRIPTION OF THE DRAWING

In the detailed description which follows, reference will be made to the drawing comprised of the following figures:

FIG. 1 is an isometric view of an insulated wall form comprised of modular elements including straight wall panel forms and corner forms;

FIG. 3 is an isometric view of a corner bracket assembly or corner bracket for a corner wall form;

FIG. 7 is a side view of the corner bracket depicted in FIG. 5 viewed in the direction of the arrow in FIG. 5;

FIG. 8 is a top plan view of the corner bracket depicted in FIG. 5 as incorporated in spaced foam panels to provide a modular corner wall form;

FIG. 9 is an isometric view of an alternative construction of a corner bracket designed for a 45° corner wall form;

FIG. 10 is a top plan view depicting the corner bracket of FIG. 9 as incorporated in spaced foam panels to provide a modular, insulated corner wall form;

FIG. 11 is an isometric view of the construction of FIG. 10.

DESCRIPTION OF THE PREFERRED EMBODIMENT

Figure 2:
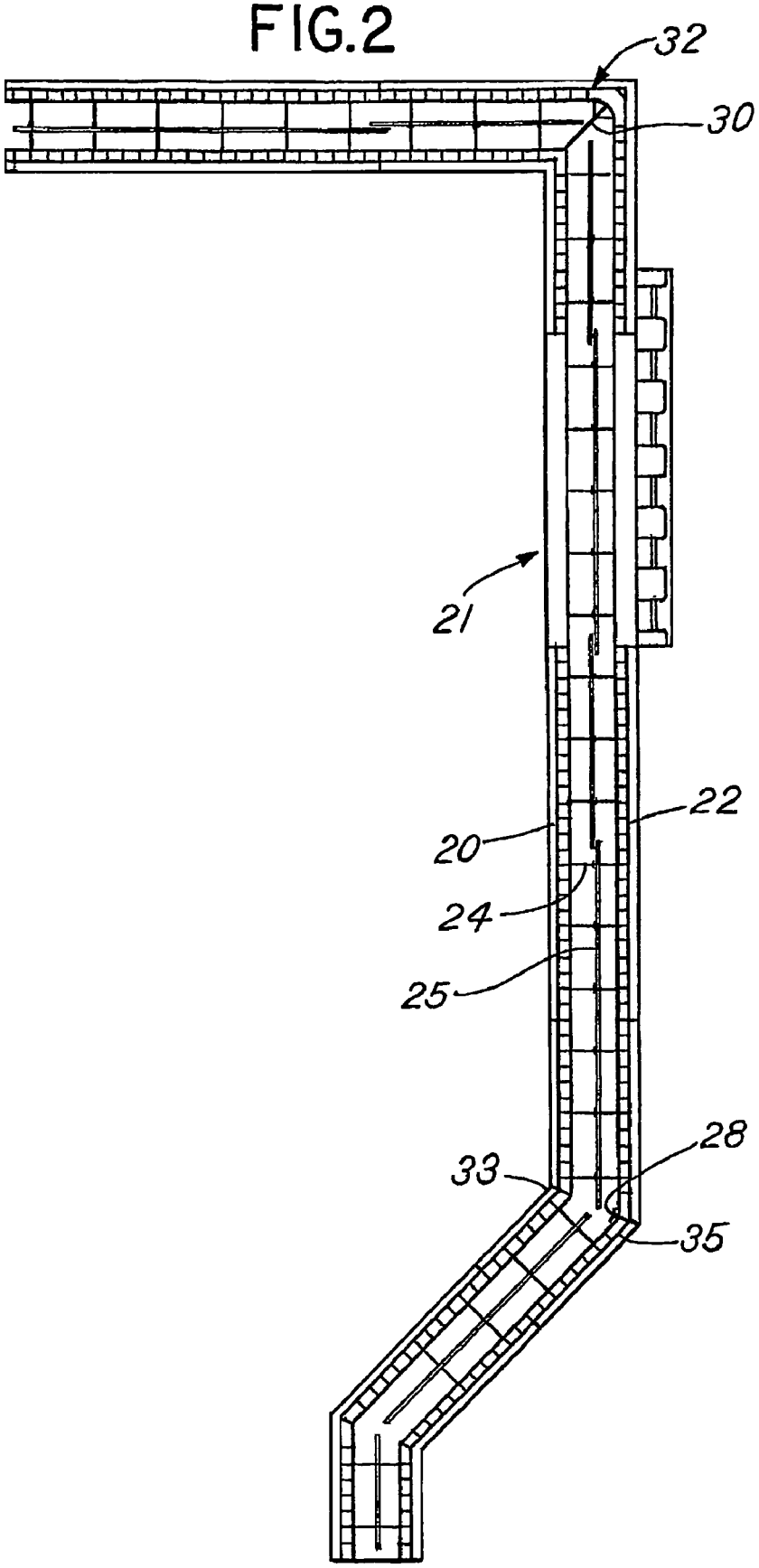
FIG. 2 is a top plan view of the wall forms of the type depicted in FIG. 1.
Figure 4:
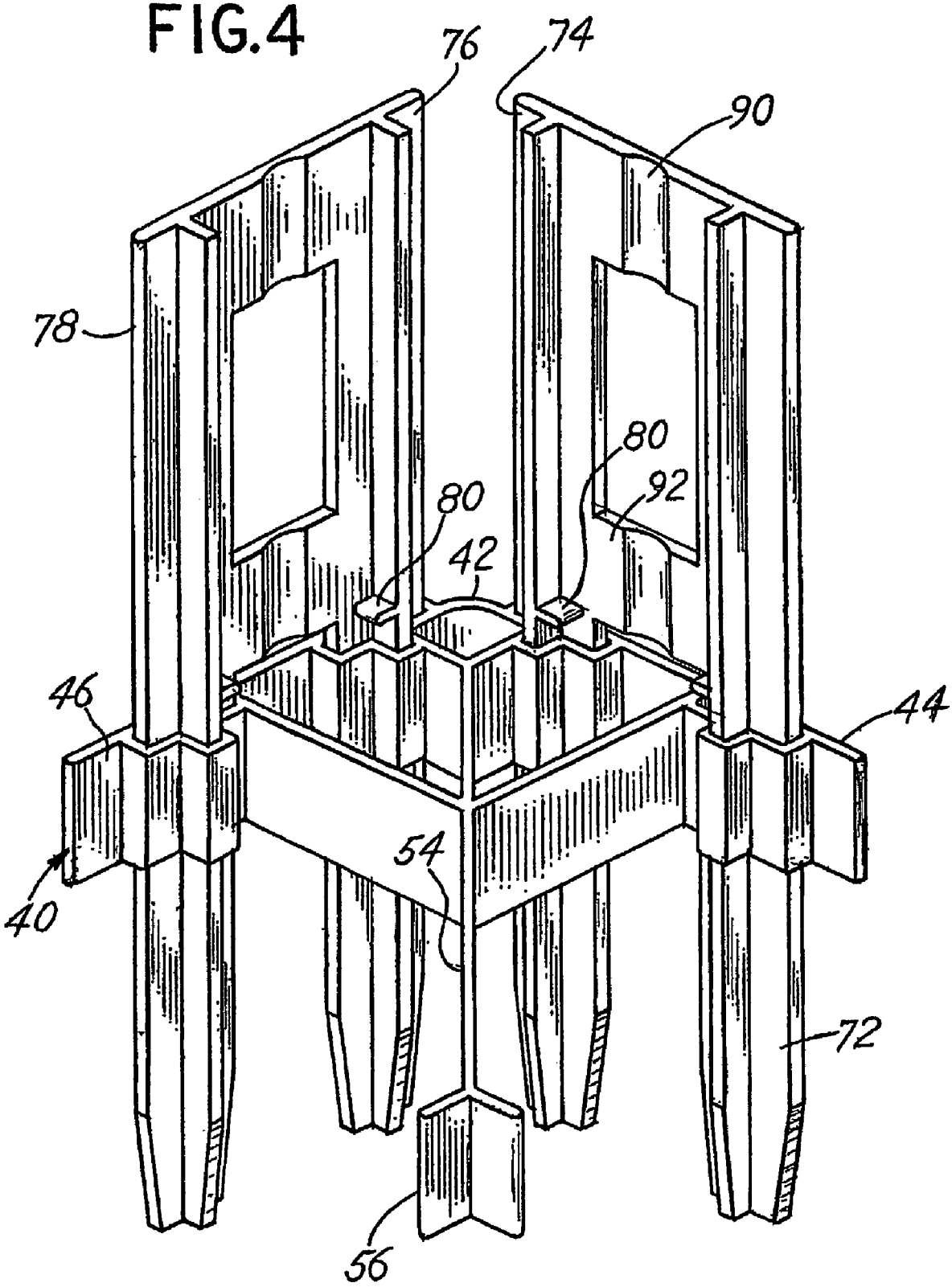
FIG. 4 is another isometric view of the corner bracket of FIG. 3 which may be employed in the creation of a modular, insulated corner wall form of the type depicted in FIG. 1.
Figure 5:
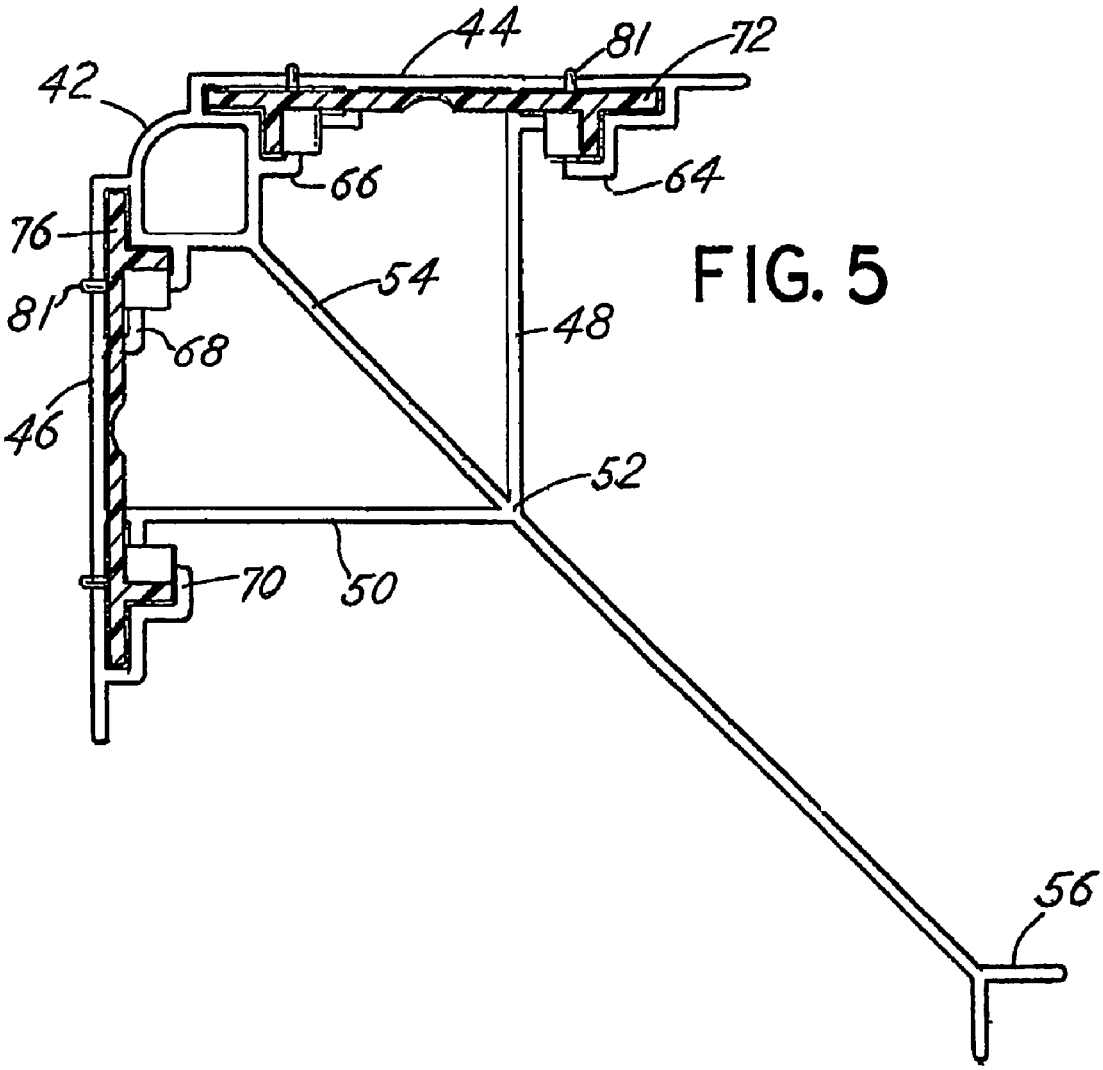
FIG. 5 is a cross sectional view of the corner bracket depicted in FIG. 3 taken substantially along the line 5-5.
Figure 6:
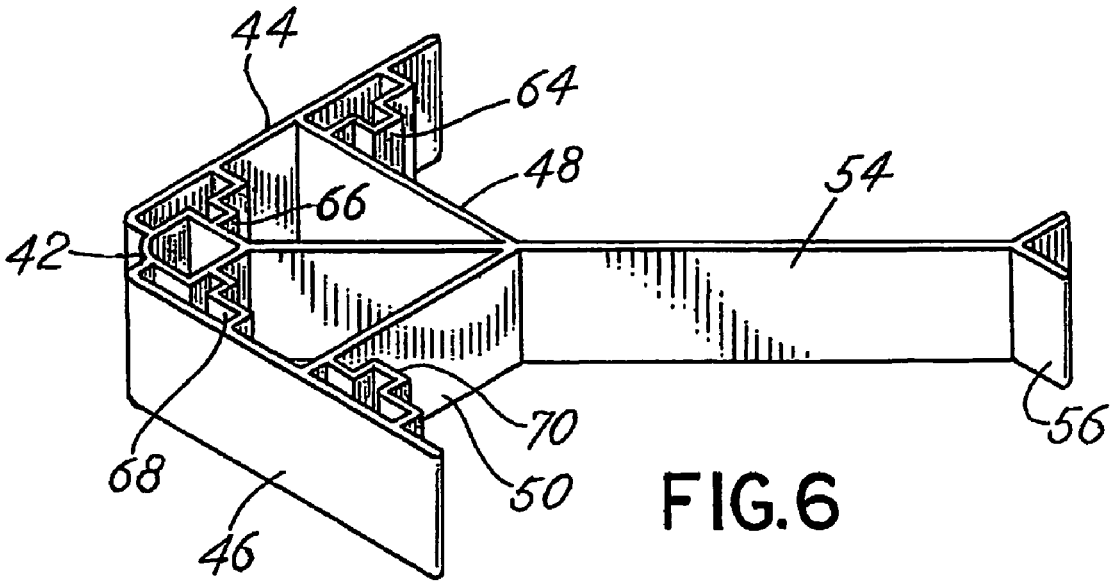
FIG. 6 is an isometric view of the horizontal assembly member or plate which is included as an element of the bracket of FIG. 3.

Referring to FIGS. 1 and 2, there is depicted an assembled array of modular, foam panel forms which are utilized, in combination, to provide a form for casting or pouring of a concrete building wall, for example. The prior art patents referenced above generally depict the manner of construction and use of such modular foam forms. Briefly, the modular forms 21 are generally comprised of modular sized, first and second panels 20 and 22 which are formed from a plastic foam material such as polystyrene. The panels 20, 22 are maintained in spaced, typically parallel, connected relationship one with respect to the other by means of brackets, connectors, struts, ties or the like 24. The number and spacing of the brackets 24 may be varied. For modular foam forms 21 which are designed for straight line sections of a wall, six to eight connectors or brackets 24 may, for example, comprise cross linking members extending between the generally parallel spaced, insulating panels 20 and 22. Such parallel or straight modular wall sections or forms, such as section 21, will thus, in combination, define a straight wall form. Steel reinforcing bars (rebars) 25 may be positioned on the brackets 24, and concrete or cement may be placed in the region between the foam panels 20 and 22 to encapsulate the reinforcing bars 25 as well as the brackets 24. The materials forming the panels 20 and 22 provide an insulating feature as well as a form 21.

The present invention relates to the construction of corner forms and brackets such as the right angle corner form 32 in FIG. 1 for a corner incorporating a corner bracket 30. Multiple corner forms 32 as well as the straight panel forms 21 may thus be assembled in various combinations to create a complex, large form for pouring of a concrete wall. Obtuse corner forms, such as obtuse corner form 28, may be constructed having an angular relationship other than 90°. For example, the form 28 defines an obtuse angle corner form including an angular inside insulating foam panel 33 and an outside insulating foam panel 38. Panels 33, 35 are joined by straight ties or connectors 24 and a molded plastic corner bracket 102 as described hereinafter. Acute angle as well as right angle forms may be made in the practice of the invention.

FIGS. 3, 4, 5, 6, 7 and 8 relate particularly to the corner bracket 30 which is constructed and designed for use in the formation of a 90° angle or right angle corner form 32. FIGS. 9, 10 and 11 illustrate an alternative corner bracket construction utilized to provide or with a 135° angle corner form. The invention is not limited to any particular angular relationship of the panel walls of a modular corner foam form, however, and thus the brackets described may be designed to be used for a wide variety of angular corner relationships.

Referring to FIGS. 3-8, the right angle corner bracket embodiment of the invention includes a first generally horizontal assembly member 40. The assembly member 40 includes a generally intermediate corner or angle defining section or portion 42, a first lateral wing extension 44 extending from the intermediate section 42 in one direction and a second lateral wing extension 46 extending from the intermediate section 42 in a generally distinct direction. The included angle between the wing extensions 44 and 46 is approximately 90°. The bracket assembly member 40 further includes a rigid cross brace member 48 connected with a second rigid cross brace member 50. The cross brace members 48 and 50 join together at a juncture 52. A bisecting reinforcing brace 54 extends generally from the apex of the intermediate section 42 and generally bisects the angle between the wing extensions 44 and 46. The brace 54 extends outwardly from the intermediate section a distance which enables insertion of distal end 56 of the brace 54 into an inside foam panel wall such as depicted in FIG. 8 as the foam panel wall 60. Thus, referring to FIG. 8, an outer right angle foam panel wall 62 encapsulates the wing extensions 44 and 46 with the brace 54 extending through the space between the panels 60 and 62 to be encapsulated and included within the inside molded corner foam panel 60 during the molding operation of the corner foam form 32. Straight ties 24 may also be molded into the corner forms extending between parallel sections of the panels 60, 62. Note the straight ties 24 include generally vertical strips or plate members 79. These plate members 79 act as furring strips for attachment of siding, etc. to the panels.

The wing extensions 44 and 46 each include first and second vertical tracks or slots 64 and 66; 68 and 70 respectively on the inside face of the wing extensions 44 and 46. These slots 64, 66, 68 and 70 receive bayonet shaped, generally vertical, plate members or strips which slide into the slots 64, 66, 68 and 70 as depicted, for example, in FIG. 7 as well as in FIGS. 3 and 4. Thus, the 90° corner bracket further includes a series of plate members 72, 74, 76 and 78 which are arrayed in a generally vertical parallel manner with respect to one another and with respect to the horizontal assembly member 40. Each of the plate members 72, 74, 76 and 78 has a T-shaped cross section in a preferred embodiment and is slidably received respectively the compatibly shaped slots 64, 66, 68 and 70 as previously described. The bayonet shaped plate members 72, 74, 76 and 78 include a stop panel or tab 80 which limits the sliding movement into the respective slots and further include detent projections such as the detent projection 84 in FIG. 7 which limits the movement of a plate member 74 once it is inserted into an appropriate slot 66, by way of example. In this manner, the plate members, such as the plate member 74, are held in a generally fixed or locked position once inserted into their respective slots, such as slot 66. Other means such as clamps, etc. may be utilized in place of the described slots or tracks to function to connect and hold plates in position for the corner bracket.

In the preferred embodiment, the pairs of vertical plate members 72 and 74 are interconnected one with respect to the other through a molded, flexible horizontal bridge or connecting hinge section 90 and 92. That is, the generally rigid plate members 72, 74, are made from a molded plastic material and are designed to be connected one to the other by means of a flexible linkage or hinge 90 and 92. Once inserted, the plate members 72 and 74 will remain rigidly in place mounted on the wing extension 44. A detent or wedge projection 84 may be provided on one or both sides of the plate member, for example, the plate member 72. Plates such as the plate 76 may include projecting stops or studs 81 as depicted, for example, in FIG. 3. In other words, various means may be utilized to generally lock the vertical plates 72, 74, 76, 78 in position in the assembled combination with the generally horizontal assembly member 40 of the corner bracket.

FIG. 8 also illustrates the manner in which a 90° corner bracket is encapsulated within foam panels 60, 62 defining the inside face and outside face of a modular corner mold form wherein the foam panel walls 60, 62 are defined by integrally molded right angle foam walls. Note that the horizontal assembly members are typically encapsulated within the foam material as are the vertical brackets or vertical plate members 72 and 74. With the construction of the invention, the vertical plate members 72 and 74 may be positioned closely adjacent a corner; such as a corner 75 of a mold form. Positioning the vertical plate members, as described, enables the attachment of wall board by fasteners, for example, tightly to the region adjacent the corner of the mold form.

That is, typically the straight ties 24 for connecting opposed panel walls 60 and 62; includes a vertical plate member 79 which is generally encapsulated within foam material 62. The plate 79 thus serves as a means to receive fasteners for attaching wallboard, siding, or the like, to the foam panel 62. In like fashion the plates 72, 74 have a similar function. This resolves a problem of prior art corner constructions that did not include a vertical plate member positioned near a corner, such as a corner 75. With the present invention, the positioning of a plate member, such as the plate member 72 or the plate member 74 at the corner 75 enhances the ability to construct and attach wallboard or the like to the corner of a foam form wall.

FIGS. 9-11 depict an alternative embodiment of the invention designed, by way of example, for use with a 135° corner section, such as the corner section 100 in FIG. 10. The corner modular section 100 includes a corner bracket 102 again comprised of a horizontal assembly member 104 having at least one, and in the embodiment depicted two vertical slots 106 and 108, for receipt of the vertical plate members 110 and 112, respectively. The vertical plate members 110 and 112 are substantially identical to the vertical plate members 72, 74 affixed to a wing extension for the 90° corner construction. However; because the web or connecting portion 114 for the vertical plate members 110 and 112, as well as the connecting section 116 are flexible the vertical plate members 110 and 112 may be easily inserted and positioned in combination with the horizontal assembly member 102 to bridge the corner angle.

The horizontal assembly member 102 of this embodiment includes a foreshortened brace or extension 120 which generally bisects the angle defined by the wing extensions 104 and 107. The brace 120 extends only partially between the foam corner panels 100 and 101. FIG. 11 is an isometric view of the obtuse angle corner construction of FIG. 10 incorporating a corner bracket as depicted in FIG. 9. It will also be observed that the modular corner form foam panels 100, 101 includes some straight side connectors or ties such as the connector 130 extending between the panels 100 and 101.

Figure 12:
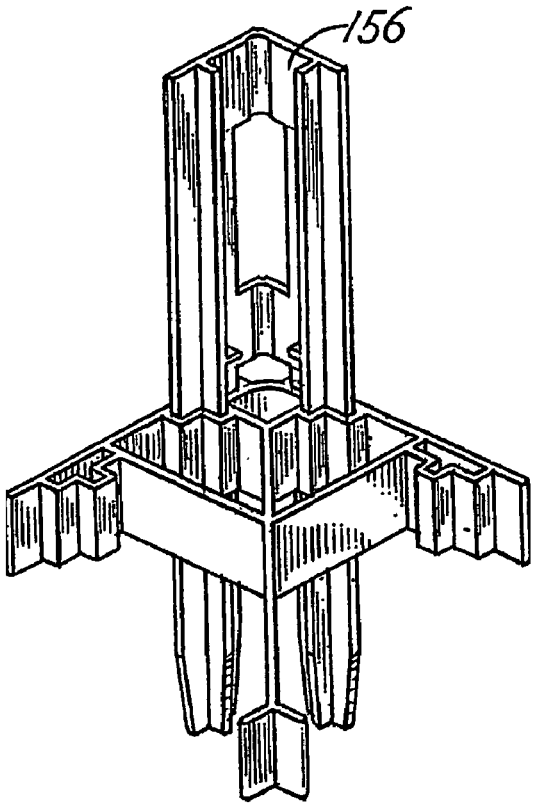
FIG. 12 is an isometric view of a corner bracket construction including two connected vertical plate members or strips.
Figure 13:
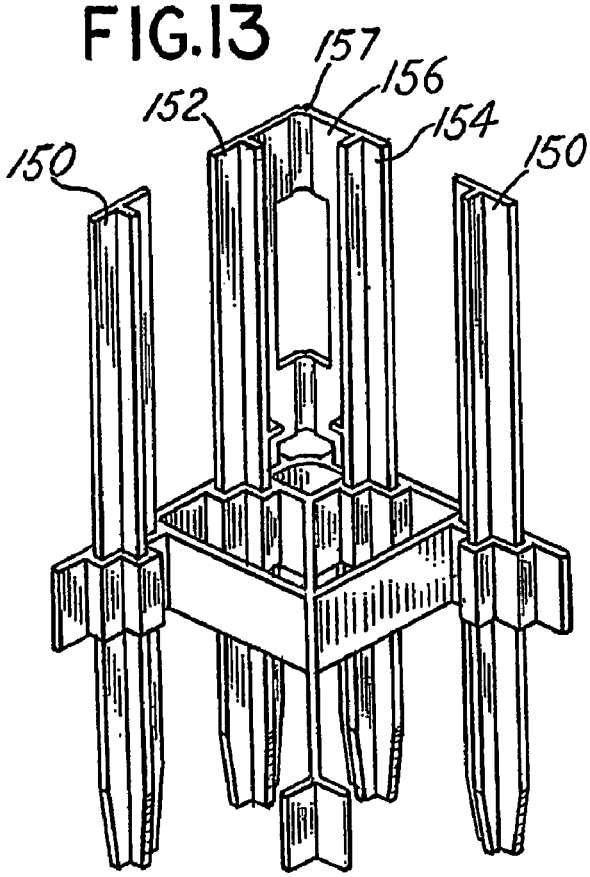
FIG. 13 is an isometric view of a corner bracket incorporating a connected vertical strip in combination with single vertical strips or plate members.
Figure 14:
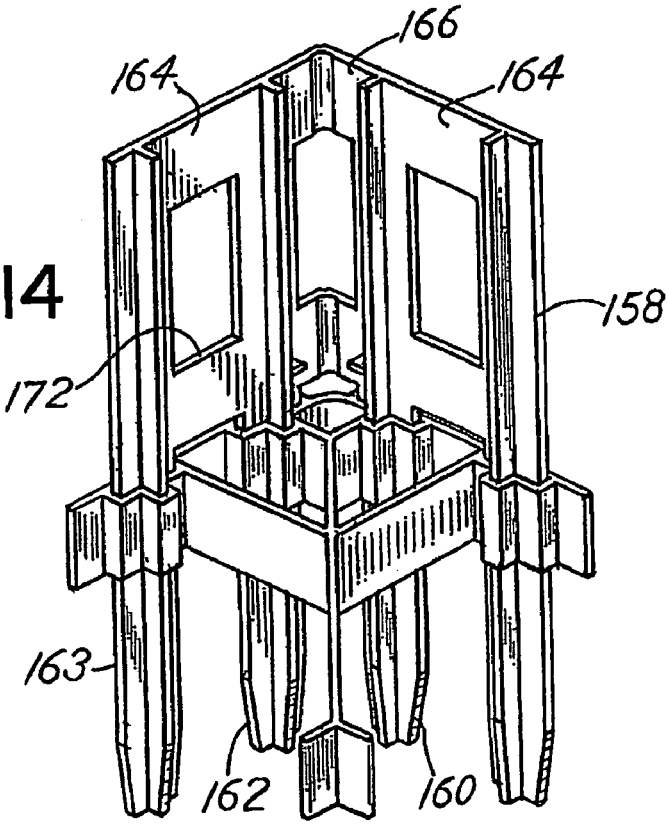
FIG. 14 is an isometric view of a corner bracket incorporating more than two connected vertical strips or plate members.

FIGS. 12, 13 and 14 illustrate variations of the combination of plate constructions in combination with various horizontal corner assemblies. Thus, a single plate 150 may be utilized, as in FIG. 13. Alternatively, two spaced plates 152, 154 rigidly connected by a horizontal bridge section 156 with a flexible hinge portion 152 may be used. Alternatively, more than two plates may be connected by a living hinge and/or a rigid hinge, such as hinge 166 in FIG. 14. Thus, three or four plates or strips 158, 160, 162 and 163 are appropriately spaced by a rigid bridge section 164 and a flexible hinge bridge section 166 in FIG. 14.

Note that the preferred embodiment of the plate construction having two or more vertical plates, two or more horizontal bridging sections, such as sections 164, 172 are used to insure stability of the assembly. The vertical rib in FIG. 9 also enhances structural integrity of the plate construction.

Figure 15:
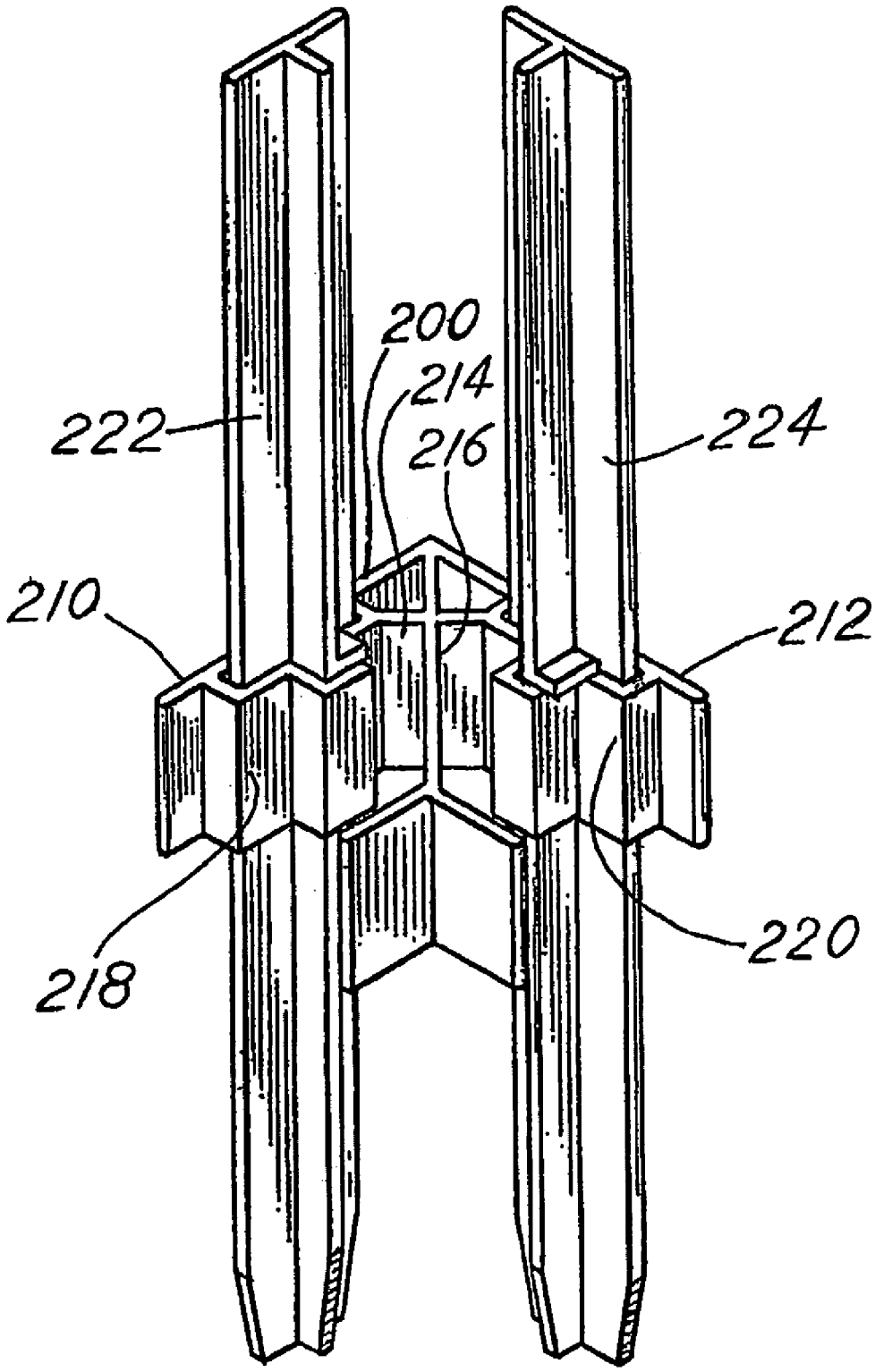
FIG. 15 is an isometric view of a corner bracket for a right angle corner, including first and second vertical plate members.

FIG. 15 illustrates yet another variation of the plate and bracket construction in combination to provide a corner assembly for a foam panel construction. The corner assembly includes a generally horizontal, molded corner 200 having a first horizontal run 210 and a second horizontal run 212 molded at a right angle thereto and joined thereto by a bracket

214. The bracket 214 includes a bisecting, planar member 216 extending from the apex defined by the horizontal runs 210 and 212. The inside of each run 210 and 212 includes a molded slot 218 and 220, respectively, adapted to receive vertical sliding plate members 222 and 224, respectively. Thus, as depicted in FIG. 15, the vertical plate members 222 and 224 are positioned so as to comprise furring type strips in the plastic or molded forms.

Other variations combining the concepts disclosed herein may be utilized. The vertical strips 222 and 224 may, for example, be integrally molded with the corner forms. The length and width of the vertical plates or strips 222 and 224 may be modified or varied. The configuration, or shape, of the vertical strips or plates 222 and 224 may be varied. The cross sectional configuration of the vertical strips may also be varied.

Numerous variations of the described embodiments may be adapted to provide a corner bracket having a defined angle and including strips of desired width and height and spacing. Thus, while there has been set forth preferred embodiments of the invention, it is to be understood that the invention is limited only by the following claims and equivalents thereof.

What is claimed is:

1. A corner bracket for use in combination with an insulating foam form panel for concrete and cement wall construction, said corner bracket comprising:

a first generally horizontal assembly including first and second connected, generally horizontal wing extensions projecting respectively laterally from each other, said wing extensions forming an included angle;

said first assembly further including a bracing element for maintaining the first and second wing extensions substantially at the included angle; and at least one separate and separable, generally vertical, plate member attachable to and detachable from at least one of said first and second wing extensions of the assembly and extending substantially vertically with respect to the said wing extensions to comprise an attachment element upon at least partial encapsulation of said plate member in a foam form panel.

2. The bracket of claim 1 wherein the assembly comprises first and second wing extensions substantially at 90° to each other.

3. The bracket of claim 1 further including a first and a second vertical plate member attachable respectively to each said wing extension.

4. The bracket of claim 1 wherein the vertical plate member is slidably attached to the wing extension.

5. The bracket of claim 1 wherein the vertical plate member includes a detent and stop mechanism for retaining the vertical plate member attached to the wing extension.

6. The bracket of claim 1 further including at least one generally horizontal bracket extension within the included angle defined by the first and second wing extensions.

7. The bracket of claim 1 further including at least one bracket extension within the included angle defined by the first and second wing extensions and generally bisecting the angle.

8. The bracket of claim 1 further including at least one bracket extension within the included angle defined by the first and second wing extensions and generally extending from an intersection of the first and second wing extensions.

9. The bracket of claim 1 wherein the included angle is less than 90°.

10. The bracket of claim 1 wherein the included angle is greater than 90°.

11. The bracket of claim 1 wherein the bracket is comprised of a molded plastic material.

12. The bracket of claim 1 in combination with at least one foam panel encapsulating the wing extensions and said at least one said vertical plate member.

13. The bracket of claim 1 wherein said first and second wing extensions are connected together at a seam defining an apex of said included angle, and including a first plate member affixed to the first wing extension and a second plate member affixed to the second wing extension.

14. The bracket of claim 13 wherein the plate members are substantially of equal size.

15. The bracket of claim 13 wherein the plate members are substantially equally spaced from the seam.

16. The bracket of claim 13 further including a bracket element extending from the seam within the included angle between the first and second wing extensions.

17. The bracket of claim 16 further including a first foam panel at least partially encapsulating at least one wing extension and a said plate member and further including a second foam panel at least partially encapsulating the bracket element said first and second foam panels being separated from each other to define at least part of a mold cavity.

18. The combination of claim 17 wherein each wing extension includes at least one vertical plate member attached thereto and said foam material encapsulates at least each said wing extension and attached vertical plate member.

19. The bracket of claim 13 wherein the first and second wing extensions define a substantially 90° included angle.

20. The bracket of claim 13 wherein at least one of the first and second wing extensions include a generally vertical track for cooperation with a plate member.

21. The bracket of claim 13 wherein the included angle is less than about 90°.

22. The bracket of claim 13 including a horizontal element extending from the seam for a distance capable of at least partial encapsulation of said horizontal element in a second foam panel spaced from a first foam panel at least partially encapsulating at least one wing extension.

23. The bracket of claim 1 further including a first foam panel at least partially encapsulating said at least one wing extension and said attachable plate member.

24. An insulating foam corner form in combination with a corner bracket said form for concrete and cement wall construction comprising:

a first generally horizontal wing extension;

a second generally horizontal wing extension, said first and second wing extensions joined together along a seam and extending from said seam to define an included angle;

at least one vertical plate member attached to and detachable from at least one of said wing extensions, and a first panel of foam material encapsulating at least in part one of said first and second wing extensions and said vertical plate member attached thereto.

25. The combination of claim 24 wherein said vertical plate is slidably attachable to said one wing extension.

26. The combination of claim 24 further including a horizontal bracing element extending from the seam intermediate the first and second wing extensions.

27. The combination of claim 26 including a second panel of foam material wherein the horizontal bracket extends into the second panel of foam material.

28. A bracket for use in combination with an insulating foam form for concrete and cement wall construction, said bracket comprising:

a first generally horizontal assembly including first and second connected, generally horizontal wing extensions projecting respectively, laterally from each other, said wing extensions forming an included angle;

at least one separate, generally vertical, plate member attachable to and detachable from said at least one of said first and second wing extension of the assembly and extending substantially vertically with respect to the said wing extensions to comprise an attachment element upon at least partial encapsulation of said plate member in a panel of foam material; and wherein the vertical plate member is slidably attached to the said at least one wing extension.

29. A bracket for use in combination with an insulating foam form for concrete and cement wall construction, said bracket comprising:

a first generally horizontal assembly including first and second connected, generally horizontal wing extensions projecting respectively, laterally from each other, said wing extensions forming an included angle;

at least one separate, generally vertical, plate member attachable to and detachable from said at least one wing extension of the assembly and extending substantially vertically with respect to the wing extensions to comprise an attachment element upon at least partial encapsulation of said plate member in a panel of foam material; and wherein the vertical plate member includes a detent and stop mechanism for retaining the vertical plate member attached to said at least one said wing extension.

30. A bracket for use in combination with an insulating foam form for concrete and cement wall construction, said bracket comprising:

a first generally horizontal assembly including first and second, generally horizontal connected wing extensions projecting respectively, laterally from each other, said wing extensions forming an included angle; and at least one separate, generally vertical, plate member attachable to and detachable from said at least one wing extension of the assembly and extending substantially vertically with respect to the said wing extensions to comprise an attachment element upon at least partial encapsulation of said plate member in a panel of foam material.

31. A bracket for use in combination with an insulating foam form for concrete and cement wall construction, said bracket comprising:

a first generally horizontal assembly including first and second, generally horizontal connected wing extensions projecting respectively, laterally from each other, said wing extensions forming an included angle; and at least one generally vertical, plate member attachable to and detachable from said at least one wing extension of the assembly and extending substantially vertically with respect to the wing extensions to comprise an attachment element upon at least partial encapsulation of said plate member in a panel of foam material.

32. An insulating foam material form with a bracket for concrete and cement wall construction comprising:

a generally horizontal assembly including a first horizontal wing extension and a connected second generally horizontal wing extension, said extensions projecting respectively generally laterally from each other, said first and second wing extensions forming an included angle;

at least one generally vertical, plate member attachable to and detachable from at least one of said first and second wing extensions to comprise an attachment element upon at least partial encapsulation of said plate member in a panel of foam material; and a first panel of foam material at least partially encapsulating said plate member.

33. The form and bracket of claim 32 wherein said bracket includes a generally horizontal bracket element in the included angle extending from and connected to the wing extensions.

34. The form and bracket of claim 33 further including a second separate panel of foam material, said bracket element being at least partially encapsulated in said second panel.

* * * * *